US009591912B2

(12) United States Patent
Lee-Holowka et al.

(10) Patent No.: US 9,591,912 B2
(45) **Date of Patent: *Mar. 14, 2017**

(54) EYEGLASS AND OTHER PERSONAL ITEMS HOLDER

(71) Applicant: Hang On Holder, LLC, New York, NY (US)

(72) Inventors: Janice Lee-Holowka, London (GB); Patricia Lee, New York, NY (US); Marc Lester, New York, NY (US); Mary Kate Buckley, Teton Village, WY (US)

(73) Assignee: HANG ON HOLDER, LLC, New York, NY (US)

( * ) Notice: Subject to any disclaimer, the term of this patent is extended or adjusted under 35 U.S.C. 154(b) by 449 days.

This patent is subject to a terminal disclaimer.

(21) Appl. No.: 13/839,729

(22) Filed: Mar. 15, 2013

(65) Prior Publication Data

US 2013/0276212 A1 Oct. 24, 2013

Related U.S. Application Data

(63) Continuation-in-part of application No. 13/663,094, filed on Oct. 29, 2012, now Pat. No. 9,066,575, which (Continued)

(51) Int. Cl.
*A45F 5/00* (2006.01)
*A45F 5/02* (2006.01)

(Continued)

(52) U.S. Cl.
CPC ..... *A45F 5/00* (2013.01); *A45F 5/02* (2013.01); *A44B 1/00* (2013.01); *A45C 13/18* (2013.01);

(Continued)

(58) Field of Classification Search
CPC . Y10T 24/13; Y10T 24/1385; Y10T 24/1397; Y10T 24/1371; A45F 5/02;

(Continued)

(56) References Cited

U.S. PATENT DOCUMENTS 89,152 A * 4/1869 Kendall ..... 2/271
235,299 A 12/1880 Routh (Continued)

FOREIGN PATENT DOCUMENTS

| | | |
|---|---|---|
| CA | 2509084 | 12/2006 |
| JP | 6-20414 | 6/1994 |
| JP | 2000-157321 | 6/2000 |

OTHER PUBLICATIONS

Japanese Office Action mailed Jun. 19, 2012 for Japanese Patent Application No. 2009-502813, 5 total pages.

(Continued)

*Primary Examiner* — Robert J Sandy
(74) *Attorney, Agent, or Firm* — Pillsbury Winthrop Shaw Pittman LLP

(57) ABSTRACT

A holder for securing eyeglasses, sunglasses or other personal items that may be securely incorporated into an article of clothing or accessory at the time of manufacture. The holder includes a base member that can be inserted into or attached to the article of clothing or accessory. A hanger is connected to the base member and includes a loop connected to a support base. One or more openings can be provided on the base member. The support base and base member can be integrally formed. The support base can be formed from part of the article of clothing or accessory. The holder allows a wearer to insert a piece of a pair of eyeglasses, or a part of another personal item, through the loop and allows the item to assume a secure and relatively flat position. The holder may also include an RFID tag and/or a covered loop.

46 Claims, 17 Drawing Sheets

FRONT

Related U.S. Application Data is a continuation-in-part of application No. 12/181,880, filed on Jul. 29, 2008, now Pat. No. 8,321,997, which is a continuation-in-part of application No. 12/017,680, filed on Jan. 22, 2008, now Pat. No. 7,979,963, which is a continuation-in-part of application No. 11/392,560, filed on Mar. 30, 2006, now Pat. No. 7,487,574.

(51) Int. Cl.
*A45C 13/18* (2006.01)
*A44B 1/00* (2006.01)

(52) U.S. Cl.
CPC . *A45F 2005/023* (2013.01); *A45F 2200/0541* (2013.01); *Y10T 29/49826* (2015.01)

(58) Field of Classification Search
CPC .... A45F 5/21; A45F 5/022; A45F 2200/0541; A44C 15/003
See application file for complete search history.

(56) References Cited

U.S. PATENT DOCUMENTS

| | | | | |
|---|---|---|---|---|
| 283,785 | A | | 8/1883 | Howard |
| 306,248 | A | | 10/1884 | Harris |
| 710,773 | A | | 10/1902 | Gordon |
| 765,125 | A | | 7/1904 | Burns |
| 1,022,504 | A | | 4/1912 | Raughtigan |
| 1,090,122 | A | | 3/1914 | Adams |
| 1,312,135 | A | | 8/1919 | Schaffer |
| 2,284,069 | A | | 5/1942 | Robertson |
| 2,297,661 | A | | 9/1942 | Okun |
| 2,457,195 | A | | 12/1948 | Bagnall, Jr. |
| 2,457,196 | A | | 12/1948 | Bagnall, Jr. |
| 2,572,889 | A | | 10/1951 | Strykower |
| 4,257,463 | A | | 3/1981 | Monaco |
| 4,272,869 | A | | 6/1981 | Willner |
| 4,458,384 | A | * | 7/1984 | Arnold ..... 24/3.3 |
| 4,558,495 | A | | 12/1985 | Olsen |
| 4,563,783 | A | | 1/1986 | Jenkins |
| 4,702,451 | A | | 10/1987 | Salazar |
| 4,894,887 | A | | 1/1990 | Ward, II |
| 4,985,968 | A | | 1/1991 | Hooper |
| 4,991,236 | A | | 2/1991 | Pritchett |
| 5,033,612 | A | | 7/1991 | Bivins |
| 5,052,083 | A | | 10/1991 | Hammer |
| 5,304,934 | A | | 4/1994 | Laskaris et al. |
| 5,351,098 | A | | 9/1994 | McDaniels et al. |
| 5,379,928 | A | * | 1/1995 | Mikkelsen ..... 24/3.4 |
| 5,394,592 | A | | 3/1995 | Quick |
| 5,491,878 | A | | 2/1996 | Janouschek |
| 5,540,367 | A | | 7/1996 | Kauker |
| 5,551,126 | A | | 9/1996 | Wallo |
| 5,699,140 | A | | 12/1997 | Fuhrman |
| 5,702,039 | A | | 12/1997 | Olaiz |
| 5,860,191 | A | | 1/1999 | Sieger |
| 5,893,198 | A | | 4/1999 | Decotis |
| 5,956,812 | A | | 9/1999 | Moennig |
| 6,405,376 | B1 | | 6/2002 | Falk |
| 6,688,507 | B2 | * | 2/2004 | McCormack ..... 24/3.3 |
| 7,487,574 | B2 | | 2/2009 | Lee-Holowka et al. |
| 7,496,991 | B2 | | 3/2009 | Avery |
| 7,774,969 | B1 | | 8/2010 | Silverman |
| 7,979,963 | B2 | | 7/2011 | Lee-Holowka |
| 8,739,368 | B2 | | 6/2014 | Murphy, Jr. |
| 9,066,575 | B2 | | 6/2015 | Lee-Holowka |
| 2002/0170147 | A1 | | 11/2002 | Heller |
| 2003/0131449 | A1 | | 7/2003 | McCormack |
| 2004/0025216 | A1 | | 2/2004 | Marogil |
| 2004/0149795 | A1 | | 8/2004 | Szarek |
| 2004/0200872 | A1 | * | 10/2004 | Wissman ..... 224/604 |
| 2004/0221428 | A1 | * | 11/2004 | Johnson ..... 24/67.9 |
| 2005/0241115 | A1 | | 11/2005 | Zoullas |
| 2007/0226957 | A1 | | 10/2007 | Lee-Holowka |
| 2007/0289438 | A1 | | 12/2007 | Thompson et al. |
| 2009/0025186 | A1 | | 1/2009 | Lee-Holowka |
| 2009/0284709 | A1 | | 11/2009 | Didner |
| 2015/0007375 | A1 | | 1/2015 | Lee-Holowka et al. |

OTHER PUBLICATIONS

Japanese Office Action mailed May 14, 2013 for Japanese Patent Application No. 2009-502813, 4 total pages.
Canadian Office Action mailed Jun. 19, 2013 for Canadian Patent Application No. 2,648,034, 3 total pages.
Japanese Office Action mailed Jun. 19, 2012.
EP 07752482.5 European Search Report dated Dec. 1, 2015.
Extended European Search Report issued May 3, 2016 in corresponding European Patent Application No. 13852043.2.
International Search report and Written Opinion issued Mar. 19, 2014 in corresponding International Patent Application No. PCT/US2013/067136.
International Search report and Written Opinion issued Dec. 20, 2016 in corresponding International Patent Application No. PCT/US2016/051695.

* cited by examiner

Front

Back

FRONT

BACK

EYEGLASS AND OTHER PERSONAL ITEMS HOLDER

CROSS REFERENCE TO RELATED APPLICATION(S)

This application is a continuation-in-part of application Ser. No. 13/663,904, filed Oct. 29, 2012, now U.S. Pat. No. 9,066,575, which is a continuation-in-part of application Ser. No. 12/181,880, filed Jul. 29, 2008, now U.S. Pat. No. 8,321,997, which is a continuation-in-part of application Ser. No. 12/017,680, filed Jan. 22, 2008, now U.S. Pat. No. 7,979,963, which is a continuation-in-part of application Ser. No. 11/392,560, filed Mar. 30, 2006, now U.S. Pat. No. 7,487,574.

BACKGROUND

Field

This invention relates to a holder for personal items that can be incorporated into, securely affixed or attached to an article of clothing or accessory, preferably at the time the article of clothing or accessory is manufactured.

Description of Related Art

Eyeglass holders have generally comprised a case or pouch for storing unworn eyeglasses, which the user normally carries in a pocket, purse or pouch. Some types of eyeglass holders have been in the form of a cord or decorative necklace with loops at the opposite ends of the cord for receiving a temple piece of the eyeglasses, which may be worn around the user's neck.

Other versions of eyeglass holders that are purchased separately and are temporarily attached by the user to an article of clothing are disclosed in U.S. Pat. Nos. 5,551,126; 5,491,878; 5,956,812; 5,033,612; 4,894,887; 5,351,098; 5,860,191; and 5,893,198. Eyeglass holders of the type disclosed in U.S. Pat. No. 5,551,126 require that the user attach a hanger to an article of clothing using threads of a button that is sewn or woven onto the front of a garment. Eyeglass holders of the type disclosed in U.S. Pat. Nos. 5,491,878 and 5,956,812 use a clip or a clamp for temporarily fastening a receiver and a holder to the desired article of clothing. Eyeglass holders of the type disclosed in U.S. Pat. No. 5,033,612 utilize a removable non-clip pin, which requires the user to perforate the garment at each wearing. Eyeglass holders of the type disclosed in U.S. Pat. Nos. 4,894,887, 5,351,098 and 5,860,191 use a non-spring tension-dependent folding type clip or a combination of a clothespin type holder and a spring clip. An eyeglass holder of the type disclosed in U.S. Pat. No. 5,893,198 uses a pivotal swivel holder that embodies an ornamental necklace, which is worn around the user's neck.

The prior art eyeglass holders may require the user to purchase a discrete holder or multiple discrete holders, which may alter the design of an article of clothing or accessory, damage the fabric and damage the temple piece of the eyeglass. Moreover, these designs may require the user to not only purchase the holder(s) separately from the article of clothing or accessory, but also to attach the holder to the garment, often at each wearing. Additionally, certain designs may limit to a certain thickness the garment or accessory to which the holder may be attached. Accordingly, there exists a need for a simple, ready-made and design-incorporated type of eyeglass or other personal item holder that can be securely affixed to an article of clothing or accessory, preferably at the time of its manufacture, to resist the unintentional separation of the holder from the article of clothing or accessory.

SUMMARY

One embodiment of the invention provides a holder for supporting a personal item having a base member and a hanger comprising a support base and a loop connected to the support base. The base member is adapted to be inserted into or attached on an article of clothing or an accessory. The holder is adapted to support the personal item hanging thereon with the base member inserted into or attached on the article of clothing or the accessory.

An embodiment of the invention relates to a holder for supporting a personal item comprising a base member having a first throughhole therethrough, a cord having a first end inserted through the first throughhole and a hanger comprising a loop and a support base connected to the loop. The support base may be affixed to a second end of the cord and the base member may be adapted to be inserted into or attached on an article of clothing or accessory. The loop may be adapted to support the personal item thereon. The term personal item may include, by way of examples, eyeglasses, sunglasses, a media player such as an iPOD or a mobile phone.

Preferably, a closure device is affixed to the cord to prevent the cord from sliding out of the first throughhole. Preferably, the base member is rectangular in shape. In another embodiment, the base member is shaped to conform to a desired space in an article of clothing or accessory.

In one embodiment, the first throughhole may be located in any portion of the base member. Preferably, the support base has a second throughhole centered lengthwise and crosswise on the support base and the cord preferably passes through the second throughhole in a direction substantially perpendicular to the support base. Preferably, the first and second throughholes have a diameter greater than the cord.

In one embodiment, the support base comprises a resilient tubular ring or cylinder having a diameter greater than the loop. In one embodiment, the support base comprises transparent material or material of any color. Preferably, the loop is a covered fabric elastic loop approximately 0.5" in diameter extending to approximately 1.5" when fully extended.

Preferably, the loop is made of formed resilient materials such as metal, fabric, rubber, or plastic, or a combination thereof. In one embodiment, the loop comprises transparent material or material of any color. Preferably, the loop is formed to accommodate a temple piece of an eyeglass or a hook attached to another personal item. In one embodiment, the loop is shaped to resemble a manufacturer's logo or other ornamental shape.

In one embodiment, the cord is looped through a needle or can be formed with a needle-like tip or a sharp end to facilitate the perforation of a garment or accessory without damaging the fabric and to facilitate threading through the base member. Preferably, the cord comprises metallic, plastic or fabric wire, cable, line or twine.

Preferably, the holder further comprises a resilient closure or attachment device for securely affixing the base member to the hanger. Preferably, the base member comprises resilient fabric, plastic, rubber, or metal material, or a combination thereof. Preferably, the support base comprises resilient fabric, plastic, rubber, or metal material, or combination thereof.

In one embodiment, the support base is shaped to resemble a manufacturer's logo or other ornamental shape.

In another embodiment, the base member comprises transparent material or material of any color.

Preferably, the closure device is rectangular and greater in size than the first throughhole in the base member. In one embodiment, the closure device is shaped to resemble substantially a clip such as that tie-pin and is greater in size than the first throughhole in the base member. In another embodiment of the invention, the closure device is a knot in the cord. In yet another embodiment, the closure device is a solder or other adhesive material. In other embodiments of the invention, the closure device may be a button or clasp, or may be a bent end or a deformed part of the cord body itself.

Yet another embodiment relates to a method of manufacturing a holder comprising a hanger comprising a loop and a support base connected to the loop, the method comprising affixing a first end of a cord to a base member; affixing a second end of the cord to the support base; and affixing the base member into or on an article of clothing or accessory, preferably during manufacture of the article of clothing or accessory, wherein the loop is adapted to support a personal item thereon. Preferably, said providing a cord having a first end further comprises affixing a closure device to the cord. The method could further comprise affixing the cord via a throughhole in said support base; passing said cord through an article of clothing or accessory; and securing said base member to said article of clothing or accessory. Preferably, the cord is looped with a needle or can be formed with a needle-like tip or sharp end to facilitate the perforation through the article of clothing or accessory without damaging the article of clothing or accessory and facilitating threading through the base member. Preferably, said affixing said first end of said cord to said base member comprises traversing the first end of said cord through a through hole in the base member. Preferably, said affixing said first end of said cord to said base member comprises attaching the first end of said cord to the base member.

Another embodiment of the invention includes a holder for supporting a personal item comprising a base member, a cord having a first end of the cord affixed to the base member; and a hanger comprising a loop and a support base connected to the loop, the support base being affixed to a second end of the cord, wherein the base member is adapted to be inserted into or attached on an article of clothing or accessory and the loop is adapted to support the personal item thereon, and an RFID tag attached to the base member.

Still another embodiment of the invention includes a holder for supporting a personal item comprising a base member, a cord having a first end of the cord affixed to the base member; and a hanger comprising a loop and a support base connected to the loop, the support base being affixed to a second end of the cord, wherein the base member is adapted to be inserted into or attached on an article of clothing or accessory and the loop is adapted to support the personal item thereon, and wherein the loop comprises an external cover or internal filling.

Another embodiment of the invention includes a method for a holder comprising affixing a first end of a cord to a support base, the support base having a loop attached thereto, affixing a second end of the cord to the support base, affixing the base member into or on an article of clothing or accessory, preferably during manufacture of the article of clothing or accessory, and affixing an RFID tag to the base member, wherein the loop is adapted to support a personal item thereon.

In yet another embodiment, a holder includes a base member and a loop connected thereto. The loop can be connected to a support base. The support base can be connected to the base member. Alternatively, a fastening device can be connected to the base member. The base member can optionally have at least one opening for attachment to an article of clothing, an accessory, or a personal item. The fastening device can be traversed through the at least one opening. In some cases, the base member has two or more openings for attachment. The openings can be openings or through holes. In another embodiment, the base member is woven or sewn to the article of clothing or accessory. The base member and support base can integrally be formed together. Alternatively, the support base is inserted through the base member. The support base may be a part of the article of clothing or the accessory of which the base member is inserted into or attached to.

A method for attachment can include affixing a base member into or on an article of clothing or an accessory during manufacture of the article of clothing or the accessory such that the loop is adapted to support a personal item thereon. In an embodiment, the base member has at least one opening, and is attached by affixing the base member using the at least one opening. Alternatively, the method for attachment includes weaving or sewing the base member to the article of clothing or the accessory. In another embodiment, a fastening device is configured for connection to the base member and for connection to the support base, and the method includes connecting the support base to the base member via the fastening device.

In an embodiment, the holder can have an opening or groove therein that separates the base member and the loop. An edge of the base member and an edge of the loop can define the opening or groove therebetween. In one embodiment, the loop of the holder is configured to flex relative to the base member, or vice versa. In another embodiment, the holder has a front face of the base member spaced relative to a front face of the loop. In yet another embodiment, the support base of the holder angles the base member away from the loop.

Additional advantages of this invention will become readily apparent to those skilled in this art from the following detailed description, wherein only exemplary embodiments of this invention are shown and described, simply by way of illustration of best modes contemplated for carrying out this invention. The drawings and description are to be regarded as illustrative in nature and not as restrictive.

Other features and advantages of the present disclosure will become apparent from the following detailed description, the accompanying drawings, and the appended claims.

BRIEF DESCRIPTION OF THE DRAWINGS

For purposes of clarity and brevity, like elements and components will bear the same designations and numbering throughout the Figures.

DETAILED DESCRIPTION

Figure 1:
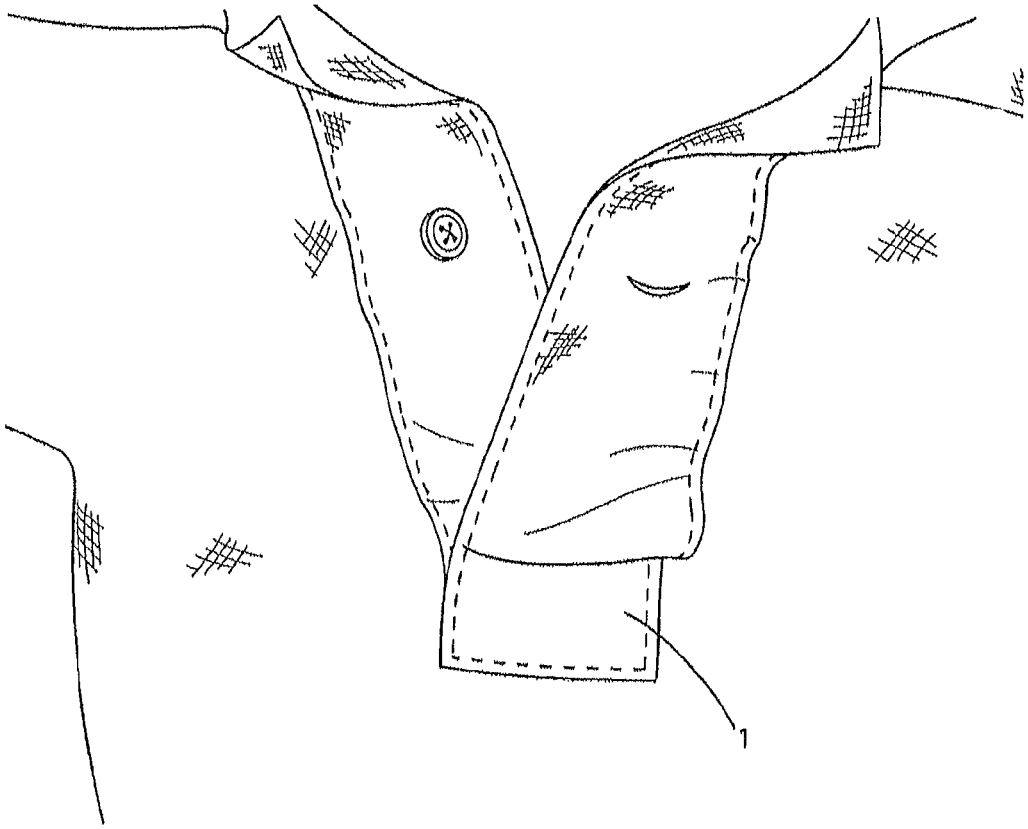
Fig. 1 (Prior Art)
FIG. 1 shows a perspective view of the front of a typical golf shirt (prior art).

An embodiment of this invention can be to provide a holder that is inherently simple in construction and inexpensive to manufacture, and is convenient in operation for the wearer. Another embodiment of this invention can be to provide a holder that is incorporated into or attached on and securely affixed to an article of clothing or accessory, preferably at the time of the article of clothing's or accessory's manufacture. Another embodiment of this invention can be to provide a holder that can be relatively unobtrusive, or, alternatively, in the form of a manufacturer's logo, depending on the desired design of the article of clothing or accessory. Another embodiment of this invention can be to provide a holder that can be readily and securely affixed to any part of an article of clothing or accessory, such as a pocket, placket band, sleeve, collar or belt loop without damaging the fabric or altering the design of the garment or accessory.

Another embodiment of this invention can be to provide a holder with an elastic loop that is sufficiently flexible to accommodate a wide range of thicknesses of temple pieces of eyeglasses and can pivotally rotate to firmly secure the eyeglasses to resist an unintentional separation of the eyeglasses from the holder.

Another embodiment of this invention can be to provide a holder with an elastic or resilient loop that can accommodate a hook attached to another type of personal item and can pivotally rotate to firmly secure the item to resist an unintentional separation of the item from the holder.

The herein disclosed embodiments and other features and advantages are attained by a holder having a base member that is simple in construction and can be readily, unobtrusively and inexpensively inserted into or attached on an article of clothing or accessory, preferably at the time of the article of clothing's or accessory's manufacture, to firmly secure the holder to the garment. The base member may be securely attached through a throughhole to a cord having one end threaded through the article of clothing or accessory and securely affixed to the base member and the other end securely affixed to the external part of the holder. The external part of the holder can include a hanger, itself comprised of a support base, and in one embodiment, a flexible elastic loop in the shape of a circle or oval. This flexible elastic loop can be made in various sizes, with one embodiment being approximately 0.5" and extending up to approximately 1.5" when the elastic is fully extended. Both the support base and the loop can also be customized to embody a manufacturer's logo. The hanger is designed so that the user can insert the temple piece of a pair of eyeglasses, or a hook attached to another type of personal item. The eyeglasses or other personal item can then assume a flat position relative to the person's body. This design can also provide for a pivotal rotation to resist the unintentional separation of the eyeglasses or other item from the holder, even as the user moves.

FIG. 1 shows a golf shirt of familiar design. Such a design typically has a generally rectangular-shaped area 1 at the bottom of the front closure where garment material is folded and sewn together.

Figure 2:
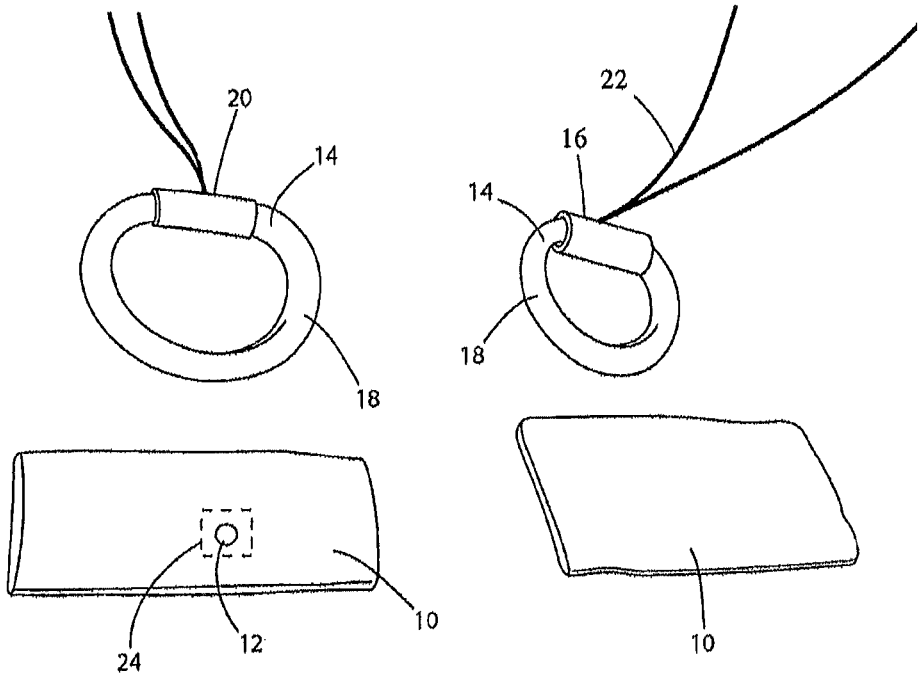
FIG. 2 shows a perspective view of one embodiment of the holder according to the present invention.

FIG. 2 shows an example of one embodiment of the eyeglass or other personal items holder. In FIG. 2, the holder comprises a base member 10 with a first throughhole 12. The base member 10 may be rectangular or shaped to conform to the desired space in an accessory or an article of clothing, such as the generally rectangular-shaped area 1 shown in FIG. 1. The base member 10 may be made of transparent material, or material of any color. Suitable materials for base member 10 may be resilient fabric, plastic, rubber, or metal, or a combination thereof. The first throughhole 12 may be located in any portion of the base member 10.

The holder also has hanger 14 comprising a support base 16, which connects to a loop 18. The support base 16 may include a resilient tubular ring or cylinder having a diameter greater than the loop 18 to affix to loop 18. Loop 18 may be formed to accommodate the temple piece of an eyeglass or a hook attached to another personal item. Loop 18 may be made of transparent material or material of any color. Suitable materials for loop 18 may be resilient materials such as metal, fabric, rubber, or plastic, or a combination thereof. Loop 18 may be a covered fabric elastic loop, preferably around 0.5" in diameter extending to around 1.5" when fully extended. The support base 16 may be made of transparent material, or material of any color. Suitable materials for support base 16 may be resilient fabric, plastic, rubber, or metal, or a combination thereof. The support base 16 and loop 18 may be shaped to resemble a manufacturer's logo or other ornamental shape.

Connected to the support base 16 through a second throughhole 20 is a cord 22 having one end that is securely affixed to the support base 16, and threaded through the first throughhole 12 in the base member 10 on the other end. The second throughhole 20 may be centered lengthwise and crosswise on the support base 16 to allow cord 22 to pass through the second throughhole 20 in a direction substantially perpendicular to the support base 16. In an embodiment, the cord 22 may be rotatably mounted to resist an unintentional separation of the item from the holder by pivotally rotating when the wearer moves.

The hanger 14 can be securely affixed to the base member 10, which has been inserted into an article of clothing or accessory, preferably at the time the article of clothing or accessory is manufactured, using a closure 24, which in one embodiment can be rectangular and greater in size than the first throughhole 12 in the base member 10. In another embodiment, closure 24 can be shaped into substantially a clip shape.

A closure 24 is an attachment device that can be used to secure hanger 14 to an article or accessory. As will be evident by the examples described below, the closure 24 can be provided in many forms, and may be provided in conjunction with a fastener 22. A closure may be at least part of a snap, a push nut, a rivet, a brad, or a solder (e.g., at the end of the fastener 22).

Using cord 22, the hanger 14 is threaded through the article of clothing or accessory. It can be threaded through the first throughhole 12 in base member 10 and the cord 22 can be permanently secured using the aforementioned closure 24 to the base member 10. The cord 22 may have a sharp end, or can be looped through a needle to facilitate the perforation of a garment or accessory without damaging the fabric and to facilitate the threading through the base member 10. In one embodiment, the first throughhole 12 in the base member 10 may have the same diameter as the second throughhole 20 in the support base, and both throughholes may be slightly larger than the diameter of cord 22. The remaining cord 22 may be cut and discarded. Cord 22 may be wire, cable, line, thread, or twine. Suitable materials for cord 22 may be metal, plastic or, fabric. The base member 10 may then be sewn or woven into a fold in the fabric of the article of clothing or accessory, rendering it practically invisible. The loop 18 and support base 16 may be incorporated directly into an article of clothing or an accessory, preferably at the time the article of clothing or accessory is manufactured.

From the foregoing, it is readily apparent that the holder described is extremely simple in construction, inexpensive to manufacture, and convenient for the user. A myriad of personal items can be securely supported in a manner that will resist the unintentional separation of the item from the holder. The holder may be suitably supported on any part of an article of clothing or accessory without damaging the fabric or material, and may be readily adapted to the manner of the design of the article of clothing and/or accessory as dictated by the manufacturer of the article of clothing and/or accessory. The holder described can be worn either in a vertical or horizontal position and may be placed in different positions (e.g., on a pocket, placket band, sleeve, collar or belt loop) on any article of clothing (e.g., a shirt, pair of pants or jacket) or accessory (e.g., bag, handbag, purse).

Figure 3:
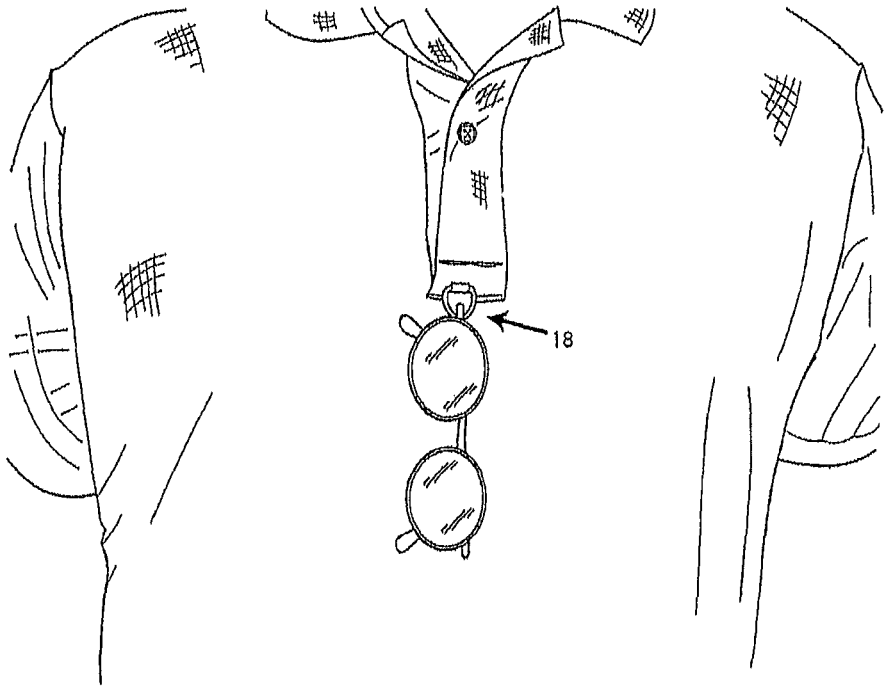
FIG. 3 shows a perspective view of one embodiment of the holder and eyeglasses supported therein according to the present invention.
Figure 4:
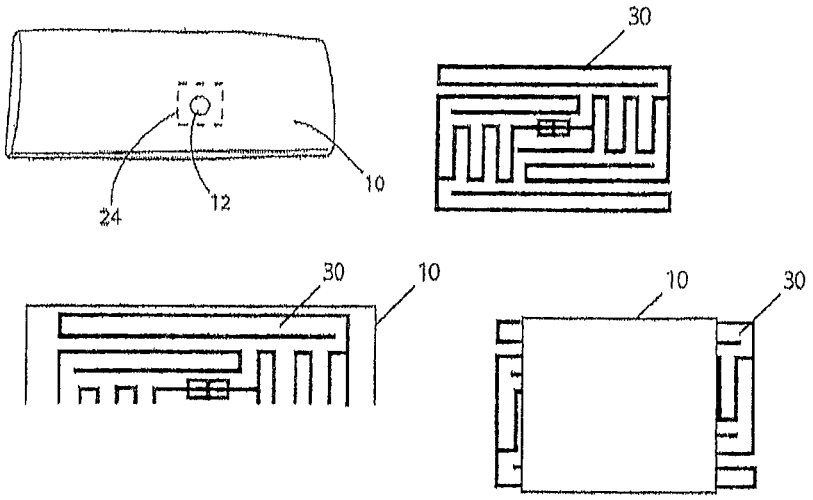
FIG. 4 shows a schematic view of one embodiment of the invention.

FIG. 3 shows an embodiment as an eyeglass holder. The base 10 member is underneath the fold in the garment (within the rectangular area containing loop 18) and is not visible from either the front or the back because it is encompassed within the fold in the garment. FIG. 4 shows another embodiment of the invention. This embodiment includes a radio frequency identification (RFID) tag 30. An RFID tag 30 is an object that can be applied to or incorporated into a product for the purpose of identification using radiowaves. Some RFID tags 30 can be read from several meters away and beyond the line of sight of the reader. Most RFID tags 30 contain at least two parts. One is an integrated circuit for storing and processing information, modulating and demodulating a (RF) signal and can also be used for other specialized functions. The second is an antenna for receiving and transmitting the signal. A technology called chipless RFID allows for discrete identification of tags without an integrated circuit, thereby allowing tags to be printed directly onto assets at lower cost than traditional tags In one aspect of the invention, the RFID tag 30 is wrapped inside base member 10. In another aspect of the invention, the base member 10, is wrapped with the RFID tag 30. In still another aspect of the invention, the RFID tag 30 is attached to either the front or the back of the base member 10. Preferably, that addition of the RFID tag 30 does not alter the functionality or the design of the holder. However, the design of the base member 10 of the holder may be modified to accommodate the RFID tag 30. With the inclusion of the RFID tag 30 in this embodiment of the invention, it is possible to track inventories. It also provides the possibility to hinder counterfeiting by allowing the identification and tracking of which garments or accessories were manufactured by official licensees or third-party manufacturers. Indeed, the present embodiment allows tracking by licensee/manufacturer, plant location, and even batch. It further may function as a security device to help counter theft. Including the RFID tag 30 on/in the base member 10, which is subsequently placed inside of the garment or accessory fabric, may prevent the unintentional removal of the label/device prior to its effective use, and may act as a substitution for alternative devices, such as the more unsightly and potentially damaging to the garment fabric hard plastic security tags.

Figure 5:
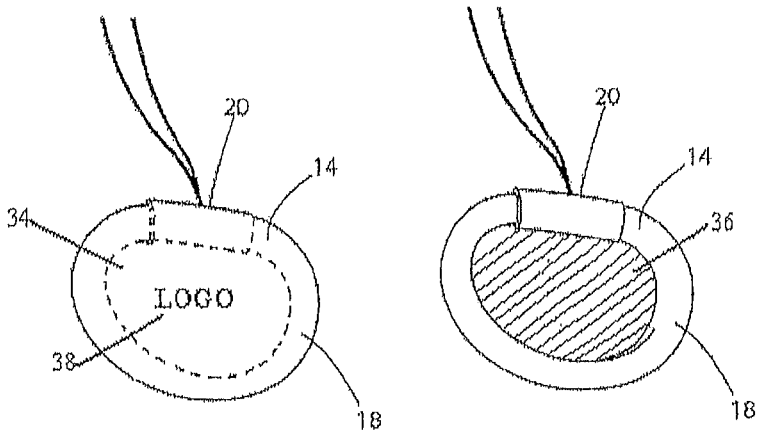
FIG. 5 shows a perspective view of one embodiment of the invention.

FIG. 5 illustrates another embodiment of the invention. This embodiment includes a covered loop 32. The covered loop 32 can be formed with an external cover 34 or internal filling 36. Preferably, the external cover 34 or internal filling 36 comprises a thin fabric which itself can accommodate a design, logo or monogram 38. The external cover 34 or internal filling 36 can also be comprised of a resilient fabric, plastic or metal material. The external cover 34 or internal filling 36 may match the color of the loop 18, be any alternative color or be multiple colors. In one preferred embodiment, the external cover 34 or internal filling 36 is be perforated, for example in quartered or one-third slits, to allow for the easy insertion and removal of the temple piece of an eyeglass or hook attached to another personal item.

Figure 6:
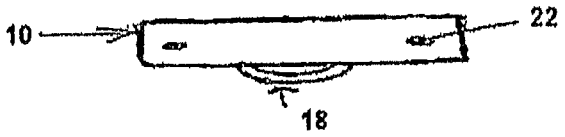
FIG. 6 shows a front plan view of another embodiment of the invention.
Figure 7:
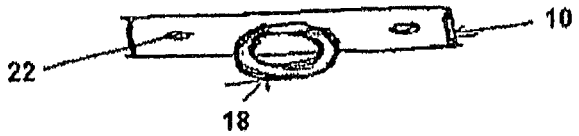
FIG. 7 shows a back plan view of the embodiment of FIG. 6.
Figure 7:
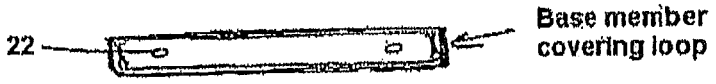

FIGS. 6 and 7 illustrate another embodiment of the invention. In this embodiment, the base member 10 may be formed as the most prominently visible part of the holder. The loop 18 may be attached preferably behind, but also in front of (e.g., see FIG. 8, FIG. 9, FIG. 33) or beneath base member 10 while the cord(s) 22 connects the holder to the base member 10 and attaches to the garment or accessory, preferably on two sides. The holder may include a closure 24 that may be in the form of a small metal closure, knot or woven or sewn into the fabric. The base member may be formed from metal, a metal chain, leather, fabric, cord or any combination thereof. Additionally, the base member 10 and the loop 18 may be formed with essentially the same shape and as one unit with the cord(s) 22 connecting the holder to the base member 10 and attaching to the garment or accessory.

In addition, the number of openings or through holes on base member 10 is not limited. In accordance with embodiments herein, more than one opening is provided on base member 10. The openings can be used to attach or secure the base member 10 to a garment or accessory. The base member can also have no through holes (e.g., see FIG. 36).

Figure 42:
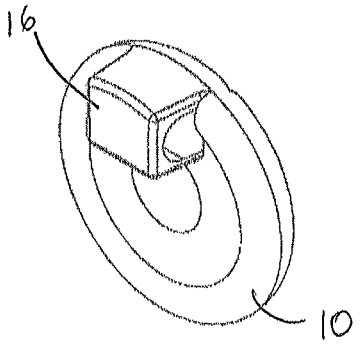
FIG. 42 shows a perspective view of another embodiment of the invention.

FIG. 42 illustrates another embodiment of a base member 10 with a support base 16 provided on the back thereof. As shown in FIG. 42, the support base 16 can extend from the back (or from the back face) of the base member 10. The base member 10 can be a button, for example. The support base 16 can receive a loop (not shown) in its opening or slot. As further detailed below, the base member 10 may be a button or similar structure, with one or more openings or holes (not shown), which can extend therethrough (i.e., through holes) for attachment to a garment or accessory.

Figure 8:
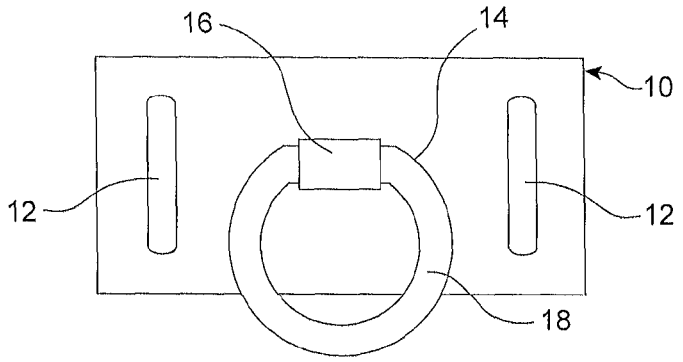
FIG. 8 shows a front plan view of another embodiment of the invention.
Figure 10:
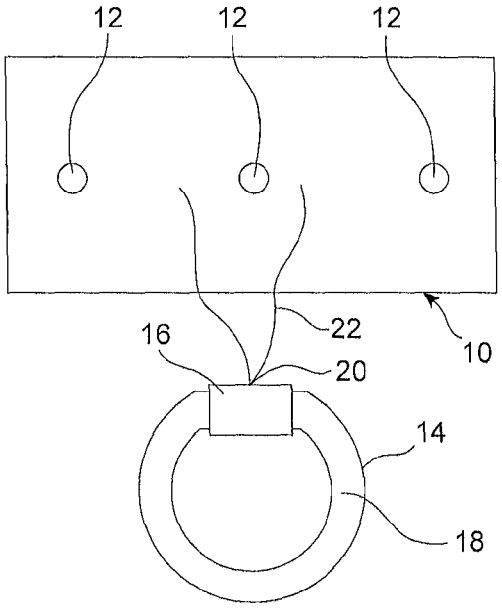
FIG. 10 shows a front plan view of yet another embodiment of the invention.

FIG. 8 shows an embodiment of the invention wherein the base member 10 has two elongate openings 12 adjacent its ends thereof. The elongate openings 12 can be used for securement of the base member 10 with the article of clothing or the accessory. The two openings 12 can be in addition to an optional (central) through hole 12 used to attach support base 16 thereto, for example. The two openings 12 can be through holes. As shown in FIG. 10, the two openings 12 can alternatively be similar in size to a first through hole 12 configured to receive cord 22 or another fastener therethrough to connect hanger 14 to base member 10. Despite their shape, the additional openings adjacent the ends of the base member 10 in FIGS. 8 and 10 can be used for attachment purposes.

Figure 9:
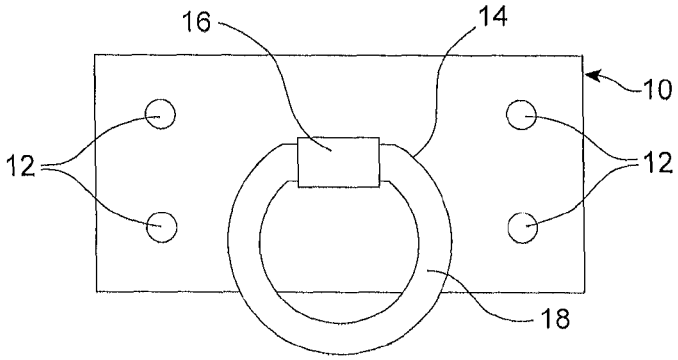
FIG. 9 shows a front plan view of another embodiment of the invention.

FIG. 9 shows another embodiment of the invention wherein the base member 10 has four openings 12 that can be used for securement of the base member with the article of clothing or accessory. The four openings 12 can be in addition to an optional (central) through hole 12 used to attach support base 16 thereto, for example.

Like the previously shown in the embodiments of FIGS. 2-7, base member 10 and support base 16 are connected to each other, including by methods such as being glued, soldered, attached together via a cord or other fastening device, or integrally formed together as one-piece. In the examples shown in FIGS. 8-10, the support base 16 can be connected to base member 10 via a cord 22 or other fastening device, for example. The cord 22 or fastener can be traversed through at least one opening of the base member 10, for example, as previously described.

However, the methods of mounting the hanger 14 (or parts thereof) and the base member 10 and/or manufacturing of the same are not meant to be limiting. Besides connecting the support base 16 and base member 10, for example, in one embodiment, the loop 18 and base member 10 may be connected.

In yet another embodiment, the base member 10 and the support base 16 of FIGS. 8-9 can also be formed as integrally together as one-piece.

Figure 11:
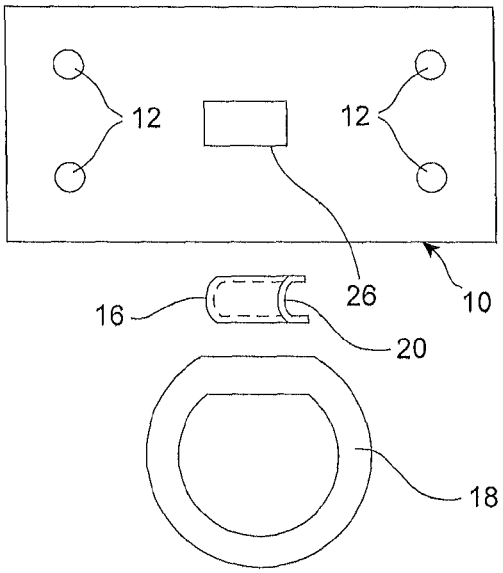
FIG. 11 shows a front plan view of still another embodiment of the invention.

In another embodiment, the support base 16 can be inserted through the base member 10. For example, an additional opening or through hole may be provided in the base member 10 in the form of a receiving opening 26, shown in FIG. 11. The receiving opening 26 may be an opening that is configured to receive support base 16 therethrough. In an embodiment, it may be formed and/or sized based on the size of the support base 16. In the illustrative embodiment, the receiving opening 26 is substantially rectangular and can be larger than openings 12 or through holes on the base member 10 that are used for attachment of the base member 10 to the article of clothing or accessory.

In one embodiment, the support base 16 is part of the article of clothing or the accessory of which the base member 10 is inserted into or securely attached to. For example, a portion of material can be formed into a loop from the material (e.g., fabric) of the article of clothing or accessory itself, or attached thereto. The portion of material can be pushed or inserted through the receiving opening 26 for receipt of the loop 18 therein. Alternatively, the support base 16 can be formed from plastic, rubber, or metal, or a combination thereof. Base member 10 can have any number of openings or through holes 12 as well, which can be used for securement of the base member 10 with the article of clothing or accessory. For example, in an embodiment, the base member 10 has four openings 12 (e.g., see FIG. 11) for securement of the base member 10 with the article of clothing or accessory. In another embodiment, the base member 10 has two openings for securement of the base member 10 to the article of clothing or accessory. Accordingly, the method of manufacture of the holder may include inserting the support base 16 through the base member 10.

Figure 12:
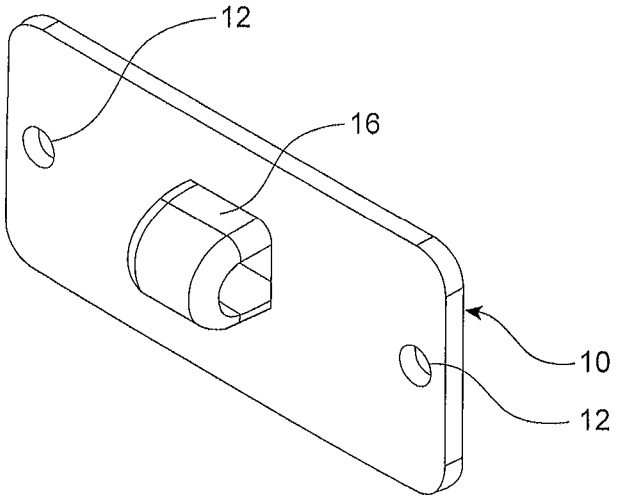
FIGS. 12 and 13 show perspective views of yet another embodiment of the invention.
Figure 13:
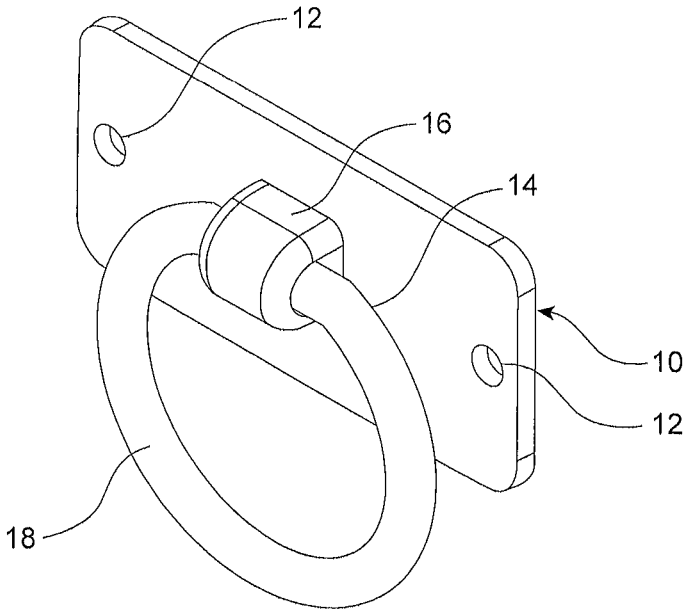

FIGS. 12 and 13 show yet another embodiment of the invention with the base member 10 and support base 16 being connected during manufacturing. For example, in one embodiment, the support base 16 can be soldered to base member 10. In another embodiment, a support base can be adhered to base member 10. The loop 18 is supported by support base 16. Further, the base member 10 can have two or more openings 12 for securement of the base member with the article of clothing or the accessory. The base member 10 and the support base 16 can also be formed integrally together as one-piece.

Figure 37:
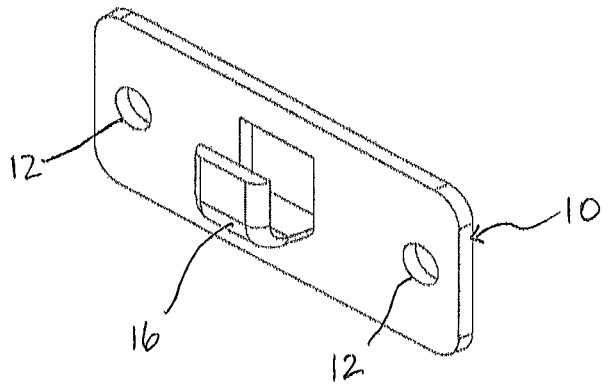
FIG. 37 shows a perspective view of another embodiment of the invention.

In accordance with yet another embodiment, as shown in FIG. 37, the support base 16 connected to the base member 10 is pre-formed with an open end having a hook-like or substantially U-shaped configuration. That is, rather than being in the form of a closed ring or tube, a top end of the support base 16 is open and configured for receipt of a loop, for example. A loop can be inserted and hung on the support base 16. Support base 16 is then bent, crushed, or deformed in a manner so as to capture the loop therein. Further, the base member 10 of FIG. 37 can have two or more openings 12 for securement of the base member with the article of clothing or the accessory. As noted above, the base member 10 and the support base 16 can be connected together (e.g., soldered) or formed integrally together as one-piece.

Figure 14:
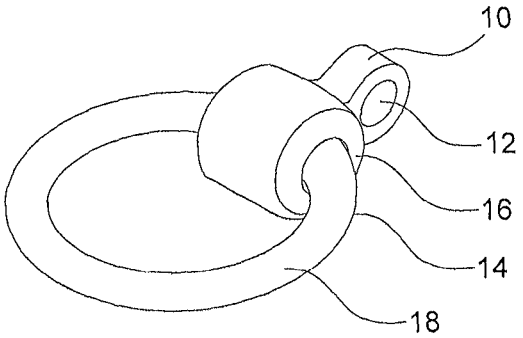
FIG. 14 shows a perspective view of another embodiment of the invention.

FIG. 14 shows another embodiment of the invention wherein the base member 10 and support base 16 of the hanger 14 are integrally formed together. Tooling may be used during manufacture to carve out a hole to form a tube for support base 16 and/or base member 10. Loop 18 is connected to base member 10 via support base 16. The base member 10 has one opening or through hole 12 for securement of the base member with the article of clothing or the accessory. The hole 12 in base member and the hole for receiving the loop 18 are in a substantially parallel configuration. The base member 10 can be secured to the article of clothing or accessory using a fastener or cord 22 through its opening or through hole 12. For example, base member 10 may be securely attached by a sewing or weaving method, similar to that of a shank button, to a garment or accessory.

Figure 38:
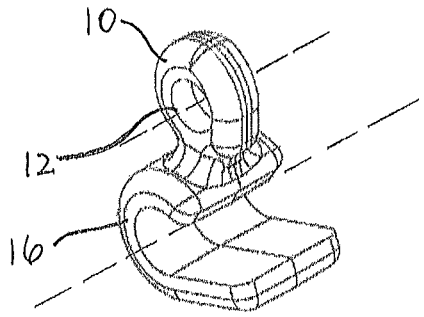
FIG. 38 shows a perspective view of another embodiment of the invention.

FIGS. 15 and 16, FIG. 35, and FIGS. 38 and 39 illustrate alternate embodiments of a base member 10 and support base 16 that are integrally formed together. As shown in FIG. 38, in one embodiment, support base 16 can be pre-formed with an open side (or end) having a hook-like or substantially C-shaped configuration. That is, one side of the support base 16 is open and configured for receipt of a loop, for example (rather than the support base 16 being in the form of a closed ring or tube, as shown in FIG. 14). A (pre-formed) loop can be inserted and hung on the support base 16. Support base 16 is then bent, crushed, or deformed in a manner so as to capture the loop therein. The base member 10 has one opening or through hole 12 for securement of the base member with the article of clothing or the accessory. The hole 12 in base member and the hole for receiving the loop 18 are in a substantially parallel configuration.

Figure 39:
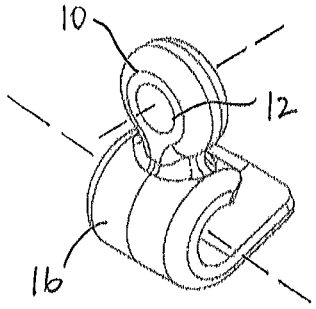
FIG. 39 shows a perspective view of another embodiment of the invention.

As shown in FIG. 39, in another embodiment, support base 16 has an open side (or end) with a hook-like or substantially C-shaped configuration configured for receipt and capture of a loop (in a similar manner as explained above with reference to FIG. 38). The base member 10 has one opening or through hole 12 for securement of the base member with the article of clothing or the accessory. In this embodiment, the hole 12 in base member and the hole for receiving the loop 18 are in a substantially perpendicular configuration.

The base members 10 of FIGS. 38 and 39 can be secured to the article of clothing or accessory using a fastener or cord 22 through its opening or through hole 12. For example, base member 10 may be securely attached by a sewing or weaving method, similar to that of a shank button, to a garment or accessory. As noted above, tooling may be used during manufacture to carve out a hole to form a tube for base member 10 in either or both FIG. 38 or FIG. 39, or such a hole can be molded.

Figure 35:
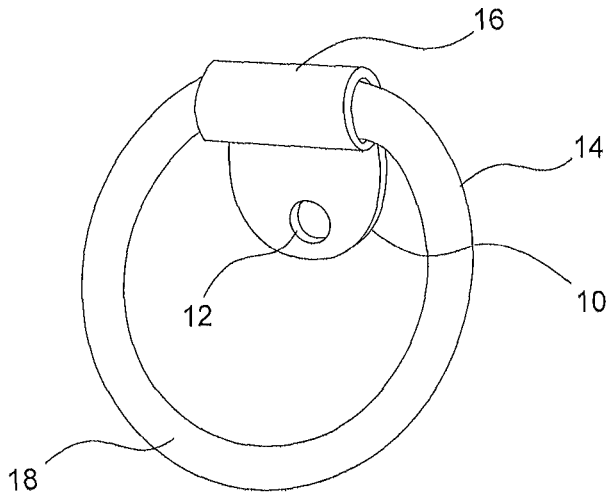
FIG. 35 shows a perspective view of another embodiment of the invention.

FIG. 35 shows an alternate embodiment of the invention of an integrally formed base member 10 and support base 16. Loop 18 is connected to base member 10 via support base 16. The base member 10 has one opening or through hole 12 for securement of the base member with the article of clothing or the accessory. The base member 10 can be secured to the article of clothing or accessory using a fastener or cord 22 through its opening or through hole 12.

Figure 15:
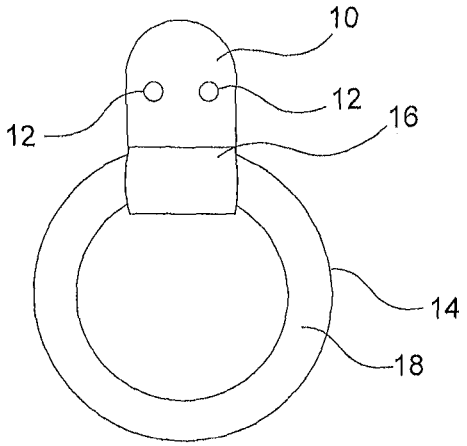
FIG. 15 shows a front plan view of another embodiment of the invention.
Figure 16:
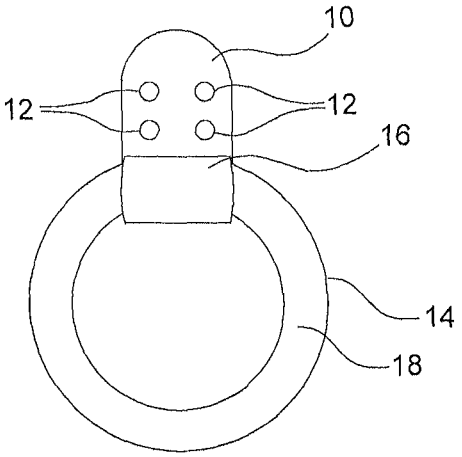
FIG. 16 shows a front plan view of another embodiment of the invention.

FIG. 15 shows another embodiment of the invention similar to that of FIG. 14 wherein the base member 10 has two openings 12 for securement of the base member 10 with the article of clothing or the accessory. FIG. 16 shows yet another embodiment with an integrally formed base member 10 and support base 16, wherein the base member 10 has four openings 12 for securement of the base member with the article of clothing or the accessory.

Figure 17:
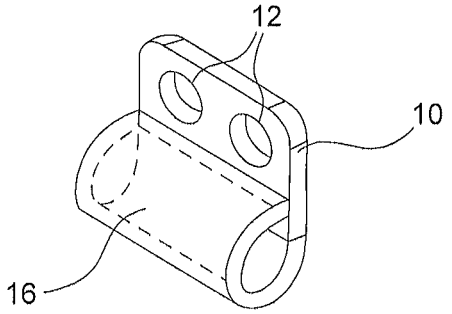
FIG. 17 shows a perspective view of yet another embodiment of the invention.
Figure 18:
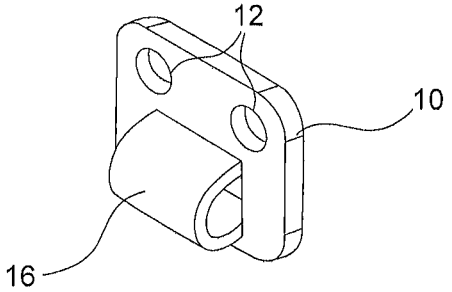
FIG. 18 shows a front plan view of another embodiment of the invention.
Figure 19:
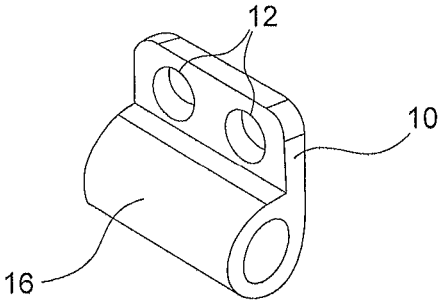
FIG. 19 shows a perspective view of still another embodiment of the invention.
Figure 20:
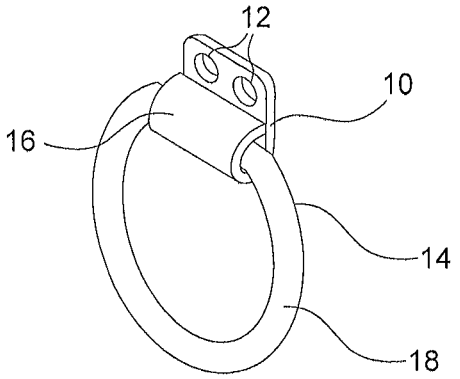
FIG. 20 shows a perspective view of FIG. 17 with a loop therein.

FIGS. 17-20 show examples of base members 10 with integrally formed support bases 16, FIG. 17 shows one embodiment wherein the base member 10 has two openings 12 and a support base 16 formed by bending a bottom portion of the base member 10 upwardly and around to form a generally cylindrical structure having a diameter greater than loop 18 to affix to loop 18 therein (e.g., such as shown in FIG. 20). FIG. 18 another embodiment that includes a base member 10 with a support base 16 extending therefrom. Tooling may be used during manufacture to push a section outwardly to form a tube for support base 16. A portion of loop 18 may be accessible from a back side of base member 10 when provided in the support base 16. In another embodiment, the base member 10 and support base 16 are molded. In an alternate embodiment, support base 16 can be attached (e.g., soldered or adhered) to base member 10. FIG. 19 shows still another embodiment wherein the base member 10 is formed integrally with support base 16 and has two openings 12 for securement with an article of clothing or an accessory. Tooling may be used during manufacture to carve out a hole to form a tube for support base 16.

Figure 21:
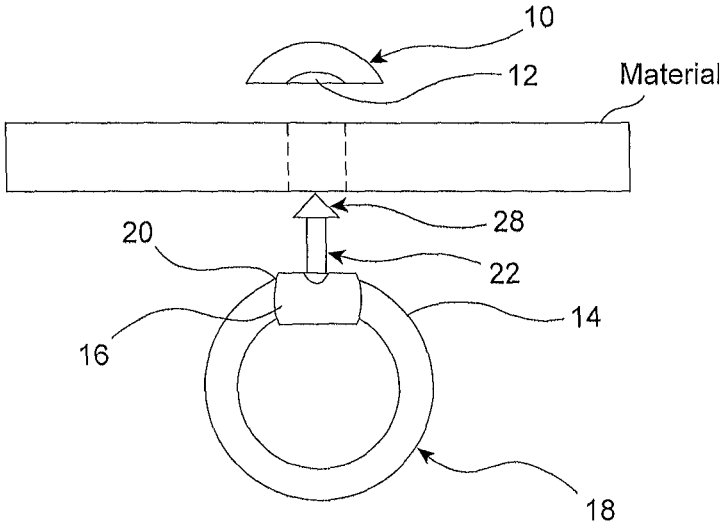
FIG. 21 shows a perspective view of another embodiment of the invention.
Figure 22:
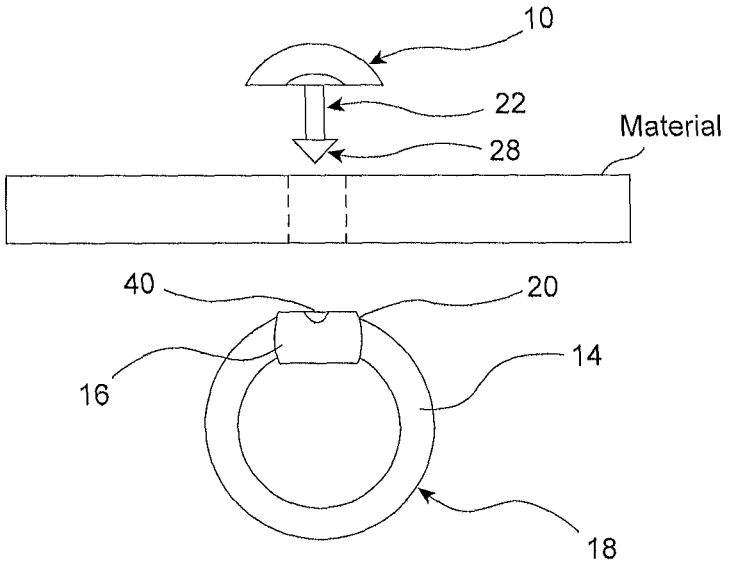
FIG. 22 shows a perspective view of another embodiment of the invention.

FIGS. 21 and 22 show perspective views of alternate embodiments of the invention. The base member 10 is provided in the form of a rivet cap that is configured to connect to a corresponding rivet portion (e.g., of a fastening device 22) to affix hanger 14 thereto. Thus, the connection of base member 10 and hanger 14 can secure the devices with the article of clothing or the accessory, e.g., by securing material or fabric between the base member 10 and hanger 14. For example, a fastener 22 (having one part of a rivet connection) can be connected at one end to the support base 16 and configured to be pushed through material (e.g., through an area or opening in the material) and then fixed or closed for assembly using base member 10.

Figure 23:
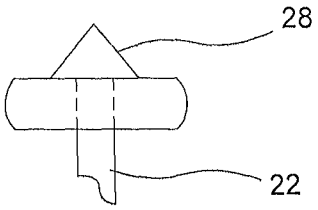
FIG. 23 shows a detailed view of a part of the embodiments of FIGS. 21 and 22.

As shown in FIG. 21, the base member 10 or rivet cap includes an opening 12 that can be a hole, a through hole, or an opening with tabs, similar to that of a push nut, for example, to receive and connect to at least a portion of fastener 22. Fastener 22 can be in the form of a needle or wire, for example, that is formed with a needle-like tip or a sharp end to facilitate the perforation of an article of clothing or accessory without damaging the fabric and to facilitate threading through the article of clothing or accessory for connection and securement with the base member 10. The opening 12 is configured to receive and at least connect with part of the fastener 22 associated with the hanger 14. For example, the fastener 22 can be attached at one end to support base 16 and have an optional catch 28 on another end. The catch 28 can be aligned and traversed through the opening 12 of the base member 10 to connect the support base 16 to the base member 10. For example, as shown in detail in FIG. 23, the catch 28 has an end that is slightly wider than its own body and the diameter of the opening 12 such that once it is pushed through and/or forced through the opening 12 of the base member 10, it is caught and at locked therewith. For example, the catch 28 can be substantially triangular. However, the shape of the catch 28, as well as the shape of opening in which is it received and locked, is not limited. In one embodiment, fastener 22 is caught or gripped by tabs in opening 12 of the base member 10 when connected thereto.

Alternatively, as shown in FIG. 22, the fastener 22 can be attached at one end to the rivet cap of base member 10 and have an optional catch 28 on another end. The hanger 14 has a connection opening 40 (e.g., in support base 16) configured to receive at least an end of the catch 28 associated with the base member 10. The connection opening 40 can be a hole, a through hole, or an opening with tabs, similar to that of a push nut, for example. Connection opening 40 can be provided in support base 16, for example. The catch 28 can be aligned and traversed through material of an article of clothing or accessory and then into the connection opening 40 of the hanger 14 for locking therewith. In one embodiment, fastener 22 is caught or gripped by tabs in opening 40 when connected thereto.

In another embodiment, the fastener 22 or a portion thereof can be deformed or crushed when attached to base member 10 in FIG. 21 or FIG. 22.

In one embodiment, the support base 16 of FIG. 21 or FIG. 22 is pre-formed with an open side (or end) and has a substantially C-shaped configuration. For example, referring to the embodiment shown in FIG. 21, it is envisioned that, in one embodiment, the support base 16 has an opening or slot on a side that is substantially opposite the fastener 22. Referring to the embodiment shown in FIG. 22, it is envisioned that, in one embodiment, the support base 16 has an opening or slot on a side that is substantially opposite the opening 40. That is, rather than being in the form of a closed ring or tube, a portion of the support base 16 is open and configured for receipt of a (preformed) loop, for example. A loop 18 can be inserted through or snapped into support base 16 via said slot in either configuration. Support base 16 is then bent, crushed, or deformed in a manner so as to capture the loop 18 therein.

The rivet cap of base member 10 and at least support base 16 of hanger 14 can be made of a hard metal (e.g., tungsten carbide, zinc, nickel, silver) or other material (e.g., plastic) that will hold up to a force required to seal the rivet components in place by bending or collapsing the fastener 22 (or part thereof) in an opening for securement to the article of clothing or accessory, and without distorting the support base 16. For example, in an embodiment, the fastener 22 is configured to be bent as it is inserted into opening 12 of base member 10 or connection opening 40 of the hanger 14. For example, the fastener 22 can be formed as a split-hybrid wire of more than one material. In an embodiment, the wire includes a part of relatively stronger material (e.g., zinc) that can retain its shape a part of relatively weaker material (e.g., brass) that can be bent to seal the rivet (e.g., base member 10 and support base 16) together. In another embodiment, for example, the fastener 22 includes a spliced wire designed to be split after insertion into the garment and the rivet cap or hanger 14 is pushed thereon. The fastener 22 does not have to split into two parts, however; it can be split into more sides, or alternatively, does not have to split at all, but rather bent within the opening 12 or 40 in one or more directions.

As previously noted, in accordance with an embodiment, the opening 12 and/or opening 40 can be configured to connect and lock with fastener 22 by catching or gripping the fastener 22 therein. Although shown in FIGS. 21-23 with catch 28 in the form of an end that is larger than its body, the fastener 22 can be received and caught by tabs without any special end configuration. For example, a bolt or rod can be captured by tabs in an opening. Thus, a catch 28 may or may not be provided. For example, in one embodiment, a push nut or cap nut—or similar features therefrom—is used to connect the base member 10 and hanger 14. As understood by one of ordinary skill in the art, push-nuts are slid on for installation, but removing them typically requires that they be destroyed in the process. Push-nuts feature angled tabs or teeth on a side designed to grip against a shank of a bolt or rod that they are fastened to. Similar tabs or teeth can be provided within opening 12 and/or opening 40 to grip the fastener 22. Such a push-nut configuration does not require any portion of a shaft or a bolt or body of the fastener 22 to be modified for use. Because there are no special requirements for gripping, a push-nut can be used for attachment onto a variety of shafts. Accordingly, the parts associated with base member 10 and/or hanger 14 can be formed in a similar manner. The fastener 22 can be formed from plastic or metal, for example.

Also, less motion and work is required to attach parts with a configuration like a push-nut, so it is easier to automate the process. For example, one to two dimples on the sides of a push-nut opening 12 or 40 press into the body of the fastener 22 and securely hold the connected parts in place. Alternatively, there may be a series of tabs or teeth for holding the connections shown in FIGS. 21 and 22.

Furthermore, because thread can often break, a snapping or gripping connection between base member 10 and hanger 14, such as using tabs in the opening 12 or 40 similar to those provided by a push-nut, can be advantageous. There is also a reduced amount of time required to replaced machinery (or parts thereof) used to connect base members 10 and hangers 14 to articles or accessories.

Push-nut closures such as those described above provide an attractive and secure means of capping exposed components. Push-nuts can be made in from various metals/alloys, in a variety of shapes, and with various coverings (including rhinestones, mother-of-pearl, etc.) and/or can be painted to match a color of a garment or accessory. Accordingly, the base member 10 or hanger 14 (or portions thereof, e.g., openings 12 or 40) can be formed with similar features of push nuts.

In accordance with yet another embodiment, the rivet cap acts as a closure 24 to be used with a base member 10. The closure 24 can be a separate member from base member 10. The closure 24 can fix the hanger 14 to the base member 10. For example, the base member 10 and hanger 14 can be secured to an article of clothing or accessory, and the rivet cap can be attached or secured with the support base 16 and/or a fastening device 22. In an embodiment, the base member 10 and closure 24 in the form of a rivet cap are designed to secure material or fabric between the base member 10 and closure 24. In another embodiment, for example, the base member 10 can be provided on the same side as the rivet cap, such that the fastening device 22 connected at one end to the support base 16, is inserted through material or fabric of the article of clothing or accessory and then through base member 10 (e.g., using a through hole 12) and secured with the rivet cap.

Figure 24:
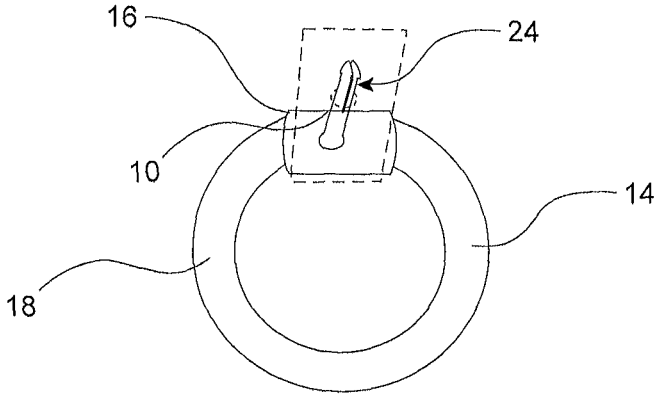
FIG. 24 shows a perspective view of yet another embodiment of the invention.

FIG. 24 shows a perspective view of yet another embodiment of a brad that is configured to be bent or crimped for attachment to an article of clothing or accessory. The brad can be attached to a base member 10, like a fastener 22, or can itself act as the base member 10. A brad is a device with a top portion or head with one or more legs extending therefrom that are configured to be folded and/or bent for attachment or securement (e.g., to an article of clothing or accessory). The one or more legs of the brad are configured to affix the hanger 14 to the article of clothing or accessory. In an embodiment, the brad is a base member 10 that has a first end or head configured for connection to the support base 16 and a second end (e.g., one or more legs) configured to act as a closure 24 for securing the base member 10 and thus the connected hanger 14 to a material of an article of clothing or accessory (e.g., see FIG. 24). In an embodiment, brad is integrally formed on support base 16.

The brad or base member 10 can be formed from a wire of sufficient tensile strength that can hold the hanger 14 in place after the wire has been bent. Wire can be spliced to split into one, two, or more directions after it is inserted into the garment or accessory, thereby securing the holder in place on the garment or accessory.

Figure 25:
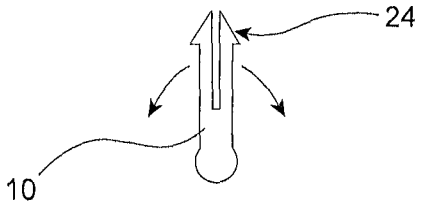
FIGS. 25 and 26 show detailed views of parts and a method of use of the embodiment of FIG. 24.
Figure 26:
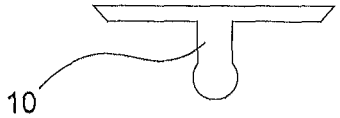

For example, as shown in FIG. 25, the wire can have two legs that are configured to be inserted at least through an article of clothing or accessory for attachment of holder 14 therewith. The legs are configured to be bent via force away from each other and towards a surface of the material, as indicated by the arrows. FIG. 26 shows an example after bending the legs of the wire, wherein the legs are substantially in the same plane.

Figure 27:
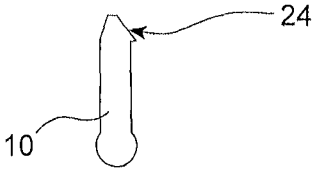
FIGS. 27-31 show alternatives for use with the embodiment of FIG. 24.
Figure 28:
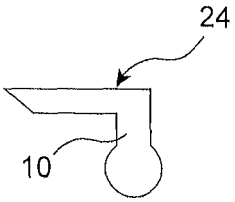
Figure 29:
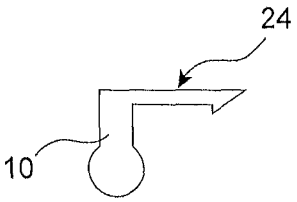
Figure 30:
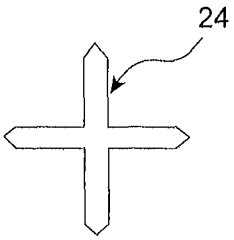
Figure 31:
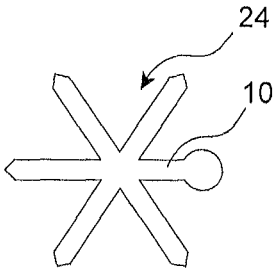

FIGS. 27-31 show alternatives for a brad. For example, as shown in FIG. 27, a brad can have a single leg that is configured to be bent any number of ways (see FIGS. 28 and 29). Moreover, in another embodiment, the brad comprises more than two legs that are configured to be bent to secure the hanger 14 to at least the article of clothing or accessory. For example, the wire can include four legs as shown in FIG. 30 or six legs as shown in FIG. 31.

In accordance with an embodiment, hanger 14 is configured to be affixed to the base member 10 using the one or more legs of the brad. That is, the brad is a fastener 22 that can have one end configured for connection to the base member 10 and a second end configured for connection to the support base 16. In one embodiment, the legs of the brad are inserted through opening 12 in base member 10, and the base member 10 is used for insertion in or attachment to (e.g., sewn, woven, or adhered) an article of clothing or accessory. For example, one end of the brad can be connected to support base 16 such that its closure legs extend through a through hole 12 of base member 10. In an embodiment, the brad is integrally formed on support base 16.

In another embodiment, base member 10 is sewn, woven, or adhered to an opposite side of a garment or accessory than the hanger 14, over the bent wire portions, to substantially cover and thus prevent and avoid the bent wire portions from touching the skin of the garment wearer or snagging on another item placed in the accessory.

Figure 32:
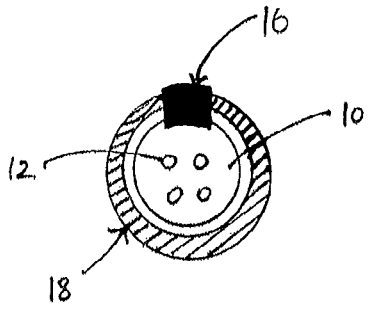
FIG. 32 shows a front plan view of another embodiment of the invention.

FIG. 32 illustrates another embodiment of the invention. Base member 10 may be provided in a shape or form similar to that of a button, for example, with one or more openings 12 or throughholes. In this embodiment, the base member 10 has four openings 12; however, any number of openings may be provided. The loop 18 is attached on top of base member 10 via support base 16.

Figure 40:
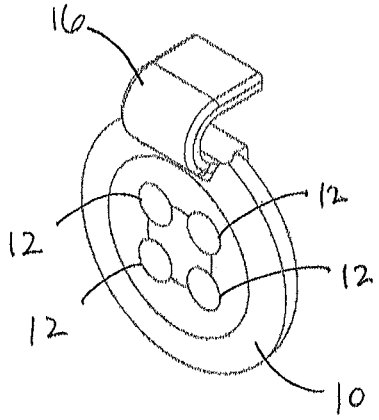
FIG. 40 shows a perspective view of another embodiment of the invention.

The support base 16 can have a tubular configuration with a through hole or slot for receipt of the loop 18. In another embodiment, as shown in FIG. 40, the support base 16 can be pre-formed with an open end or side with a hook-like or substantially C-shaped configuration configured for receipt of a loop (in a similar manner as previously explained, for example, in FIG. 38). That is, rather than being in the form of a closed ring or tube, a top end of the support base 16 is open and configured for receipt of a loop, for example. A (preformed) loop can be inserted and hung on the support base 16. Support base 16 is then bent, crushed, or deformed in a manner so as to capture the loop therein. Base member 10 is provided in a shape or form similar to that of a button, with one or more openings 12 or throughholes. In this embodiment, the base member 10 has four openings 12; however, any number of openings may be provided. The loop 18 is attached on top of base member 10 via support base 16.

Figure 33:
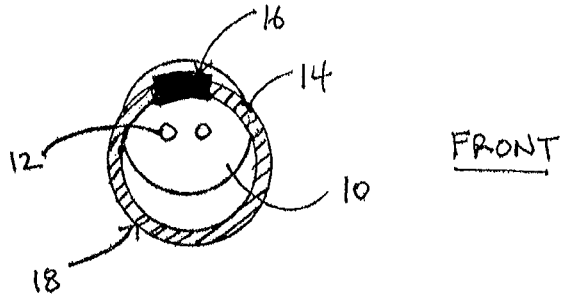
FIG. 33 shows a front plan view of another embodiment of the invention.
Figure 41:
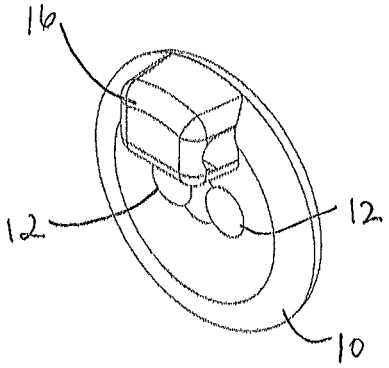
FIG. 41 shows a perspective view of the embodiment of FIG. 33.

FIG. 33 illustrates another embodiment of the invention. Instead of attachment behind or on a back of a base member, as shown in FIGS. 6 and 7 and FIG. 42, for example, the loop 18 may be attached in front of base member 10. Base member 10 may be in a form similar to that of a button with one or more openings 12 or throughholes. In this embodiment, the base member 10 has two openings 12; however, any number of openings may be provided. The loop 18 is attached on a front of base member 10 via support base 16. FIG. 41 illustrates a perspective view of the base member 10 shown in FIG. 33. As shown, the support base 16 can be configured to extend from a front (or a front face) of the base member 10.

To secure either of the designs in FIG. 32 or 33 with a garment or accessory, the openings or through holes 12 may be used. For example, the base members 10 may be sewn or woven onto a part of the garment or accessory using cord 22 or thread through openings 12. However, in another embodiment, the openings 12 may be decorative. For example, it is envisioned that such as these (or any of the embodiments disclosed herein) may be securely attached using the back part of the base member 10. As one example, base member 10 can be adhered to a garment or accessory. As another example, base member 10 may be a decorative element with a locking part on its back (e.g., like a rivet or snap part) that is configured to be secured with a closure 24 for attachment to a garment or accessory (e.g., like rivet cap or a corresponding receiving snap).

Figure 34:
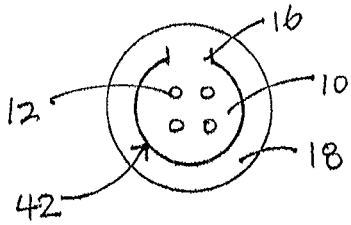
FIG. 34 shows a front plan view of yet another embodiment of the invention.

FIG. 34 illustrates an embodiment of the invention. Shown are base member 10, support base 16, and loop 18 formed integrally together. Any number of openings or holes 12 can be formed in base member 10. For example, in an embodiment, a single mold or piece of plastic, metal, or other suitable material is used to form the hanger. A groove 42 or cut-out can be formed in the structure to separate the base member 10 from loop 18, for example. An edge of the base member 10 and an edge of the loop 18 can define the opening or groove therebetween. In one embodiment, base member 10 and loop 18 are formed at an angle relative to each other with support base 16 connecting the two. In another embodiment, the base member 10 and loop 18 can be substantially moved relative to one another (e.g., by bending or moving support base 16). The size of the groove 42 can vary. In one embodiment, the groove 42 is a slit (e.g., see FIG. 34).

Figure 43:
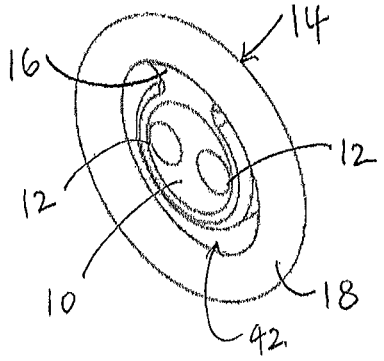
FIG. 43 shows a perspective view of another embodiment of the invention.

FIG. 43 illustrates an exemplary embodiment of a holder with a base member 10 in the form of a button. An edge of the base member 10 and an edge of the loop 18 define the opening or groove 42 therebetween. The groove 42 in FIG. 43 is provided as a larger opening or space substantially separating a relatively smaller base member 10 from the loop 18. The device in FIG. 43 can be flexible. For example, loop 18 can be configured to flex relative to base member 10, or vice versa, as noted above. Also, in one embodiment, a front face or surface of the base member 10 in FIG. 43 is spaced relative to a front face of the loop 18. In an embodiment, the support base 16 angles the base member 10 away from the loop 18 such that the base member 10 is set back from or relative to the loop 18. In another embodiment, the loop 18 can be set back from the base member 10. Base member includes one or more openings 12 therethrough for attachment to the article of clothing or the accessory.

Figure 44:
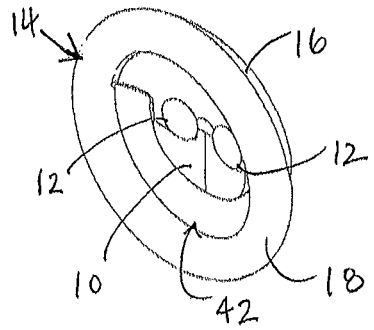
FIG. 44 shows a perspective view of another embodiment of the invention.

FIG. 44 illustrates another embodiment of a holder having a base member 10 in the form of a button with a groove 42 or cut-out adjacent its a lower side. An edge of the base member 10 and an edge of the loop 18 define the opening or groove 42 therebetween. The groove 42 can be an opening or space having a "U" shape, for example, relative to loop 18 (e.g., when viewed from its front, in a forward direction). A top of the base member 10 is connected to support base 16, while the bottom of the base member 10 is spaced via the opening or groove 42 from the loop 18. In one embodiment, a front face or surface of the base member 10 in FIG. 44 is spaced relative to a front face of the loop 18. In an embodiment, the support base 16 angles the base member 10 away from the loop 18 such that the base member 10 is set back from or relative to the loop 18. In another embodiment, the loop 18 can be set back from the base member 10. Base member 10 includes one or more openings 12 therethrough for attachment to the article of clothing or the accessory.

Figure 45:
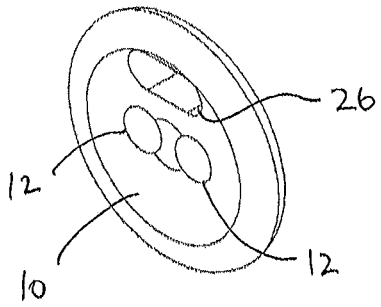
FIG. 45 shows a perspective view of yet another embodiment of the invention.

In yet another embodiment, FIG. 45 shows a base member 10 in the form of a button with an exemplary two openings 12 or through holes therein. The base member 10 has additional receiving opening 26 above the openings 12. The receiving opening 26 may be configured to receive support base 16 therethrough. In an embodiment, it may be formed and/or sized based on the size of the support base 16. In the illustrative embodiment, the receiving opening 26 is substantially similar in width as openings 12 or through holes on the base member 10 that are used for attachment of the base member 10 to the article of clothing or accessory. A portion of material can be pushed or inserted through the receiving opening 26 for receipt of the loop 18 therein.

Figure 36:
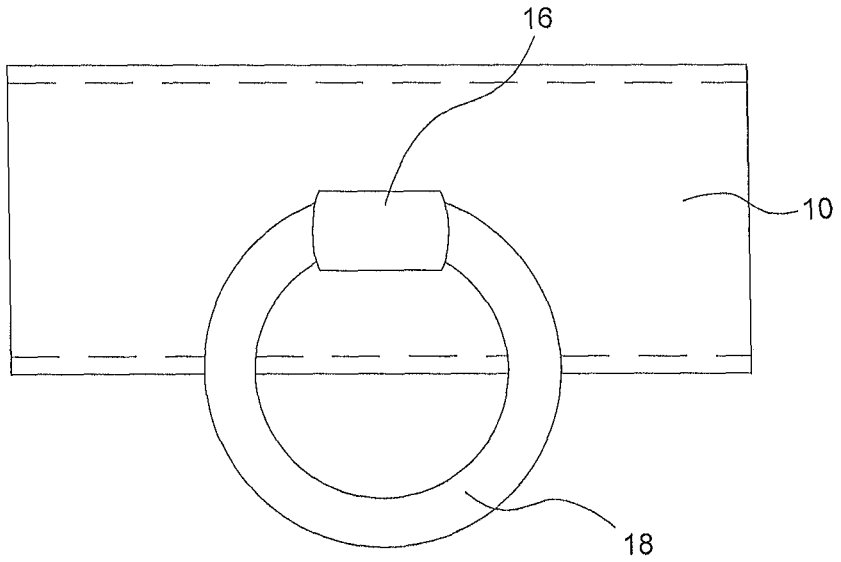
FIG. 36 shows a front plan view of still another embodiment of the invention.

FIG. 36 shows another embodiment of the invention wherein the base member 10 does not use openings for secure attachment to an article of clothing or accessory (such as shown in FIG. 2). The base member 10 may be sewn or woven (e.g., see dashed lines in FIG. 36) into fabric of the article of clothing or accessory, for example. Alternately, it can be adhered or welded or similarly attached in some manner to an item. The holder has hanger 14 comprising a support base 16 connected to a loop 18. The hanger 14 can be securely affixed to the base member 10, e.g., using a cord 22, fastener, and/or a closure 24, adhesive, or can be integrally formed therewith. The holder (e.g., the loop and support, or, the loop, support base, and cord or wire) can be attached to the base member and the base member securely affixed to the garment or accessory. The loop 18 and support base 16 may be incorporated directly into an article of clothing or an accessory.

Figure 46:
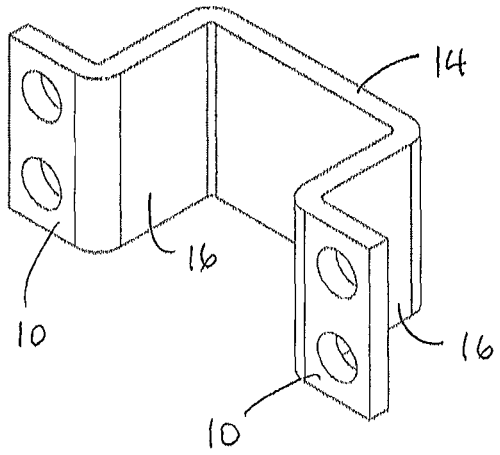
FIG. 46 shows a perspective view of still yet another embodiment of the invention.

FIG. 46 illustrates still yet another embodiment wherein the base member 10 has two recessed sides, each side having two exemplary openings 12 or through holes. The hanger 14 is provided in the form of a front rectangular plate that is parallel to the sides of the base member 10, and which is set off of/attached to the two sides of the base member 10 by two perpendicular side (support) pieces. As shown, the hanger 14 and two perpendicular side pieces form a substantially "U"-shaped configuration. The entire holder can be made as one single piece by either injection molding (e.g., plastic) or formed (e.g., metal(s)).

The use of the terms opening, hole, and through hole have been used interchangeably throughout with reference to base member 10 and are not meant to be limiting. An opening(s), hole(s), and/or through hole(s) can be used to attach support base 16 to base member 10, or base member 10 to a garment or accessory, or both. Alternatively, no holes or openings need to be provided in base member 10. The base member 10 can be securely attached to an article of clothing or accessory. Also, any of the above fastening devices (e.g., cord 22, push nut, brad) could include a removable connection on or both ends such that the fastening devices or configurations for connecting hanger 14 and base member 10 together can be disconnected or removed from at least one of the base member 10 or the hanger 14. Other alternative fastening mechanisms can be used to attach the hanger 14 to the base member 10 and/or the base member 10 to the article of clothing or accessory. One will understand that buttons and similar devices can be used for affixing and fastening.

The shape of the base member 10 is not meant to be limiting. The base member can be rectangular, square, polygonal, round, circular, ovular, and/or shaped to conform to a desired space for attachment in or on an article of clothing or an accessory. Also, the shape of the loop 18 is not limited to the illustrations shown. For example, loop 18 may be "D"-shaped, "0"-shaped, "U"-shaped, or "V"-shaped. The shape of support base 16 is also not limited. Support base 16 can be an elongated structure, substantially rectangular, substantially circular, substantially round, or substantially oval, for example.

Mention of materials for forming base member 10, support base 16, and loop 18 are exemplary only and are not limited to those mentioned herein. It should be understood that any or each of the disclosed embodiments can be formed from one or more, materials, or a combination thereof. For example, base member 10 and support base 16 may be formed from one material (e.g., plastic or metal) and the loop in another material (e.g., elastic). In an embodiment, one or more of the parts of the holder and/or base member are formed from rubberized plastic.

The base member, the support base, and the loop may be formed separately or together. For example, the base member and the support base may be formed as separate components or from a single mold (e.g., as one piece of plastic, metal, or other suitable material, or combination thereof), with the loop being attached thereto. Furthermore, it should be understood to one of ordinary skill in the art that parts such as the loop can be pre-formed as a single circular part (with no openings) or as a ring with an opening (much like a jump ring) that is later closed to form the loop by pushing open ends of the ring together and optionally securing the same. Similarly, a support base can also be formed with one or more open ends that are crushed or bent to capture a loop.

In accordance with one embodiment, the overall size of the holder (base member, support base, and loop) is adaptable to (i.e., fit within) a (button) eyelet of a garment or accessory.

In addition to the previously noted features and advantages, the disclosed embodiments reduce problems with regards to manufacture and assembly of hangers for personal items on garments or accessories. As can be understood by one of ordinary skill in the art, a golf shirt such as shown in FIG. 1 is one example of garment or article of clothing that can use any of the herein disclosed embodiments of the holder. Also, the terms "garment" and "article of clothing" are used interchangeably throughout to reference an article that is worn by a person that can incorporate a holder for personal items, and is not meant to be limiting.

Although the present invention has been described with respect to a particular embodiment and illustrating an eyeglass holder as shown in FIG. 3, other alternative versions are possible, particularly those designed to hold sunglasses or other small personal items (e.g., a media player such as an iPOD or a mobile phone). Other variations could include those designed to affix to an article of clothing without the aforementioned base member 10 and/or cord 22, those intended to affix to an accessory (e.g., a handbag) that is not an article of clothing, or other adaptations using the same or substantially similar features.

Thus, the spirit and scope of the appended claims should not be limited to the description of the versions contained herein. The foregoing preferred specific embodiments have been shown and described for the purpose of illustrating the functional and structural principles of this disclosure and are subject to change without departure from such principles. It will be apparent to those skilled in the art that various modifications may be made to the structure, arrangement, proportion, elements, materials, and components used in the practice of this disclosure. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. Various presently unforeseen or unanticipated alternatives, modifications, variations, or improvements therein may be subsequently made by those skilled in the art which are also intended to be encompassed by the following claims.

What is claimed is:

1. A holder for supporting a personal item comprising:

a base member adapted to be inserted into or attached to an article of clothing or an accessory, wherein the base member has two or four openings for securement of the base member with the article of clothing or the accessory;

a hanger connected to the base member, the hanger comprising a loop connected to a support base, the loop being adapted to support the personal item thereon, wherein the loop at least partially surrounds the base member.

2. The holder of claim 1, wherein the two or four openings are through holes.

3. The holder of claim 1, wherein the base member is woven or sewn to the article of clothing or accessory.

4. The holder of claim 1, wherein the base member is adapted to be inserted into or attached to a handbag.

5. The holder of claim 1, wherein the support base is connected to the base member.

6. The holder of claim 1, further comprising a fastening device, the fastening device having a first end configured for connection to the base member and a second end configured for connection to the support base.

7. The holder of claim 1, wherein the support base is inserted through the base member.

8. The holder of claim 7, wherein the support base is a part of the article of clothing or a part of the accessory of which the base member is inserted into or attached to.

9. The holder of claim 1, wherein the loop is configured to flex relative to the base member, or vice versa.

10. The holder of claim 1, wherein a front face of the base member is spaced relative to a front face of the loop.

11. The holder of claim 1, wherein the support base angles the base member away from the loop.

12. The holder of claim 9 wherein the loop is made of an elastic material.

13. The holder of claim 1, further comprising a groove that separates at least part of the base member and part of the loop.

14. A holder for supporting a personal item comprising:

a base member adapted to be inserted into or attached to an article of clothing or an accessory;

a hanger connected to the base member, the hanger comprising a loop connected to a support base, the loop being adapted to support the personal item thereon, wherein the loop at least partially surrounds the base member, wherein the base member and support base are integrally formed.

15. The holder of claim 14, further comprising a groove that separates at least part of the base member and part of the loop.

16. The holder of claim 14, wherein a front face of the base member is spaced relative to a front face of the loop.

17. The holder of claim 14, wherein the support base angles the base member away from the loop.

18. The holder of claim 14, wherein the support base extends from a face of the base member.

19. The holder of claim 14, wherein the loop is configured to flex relative to the base member, or vice versa.

20. A method of manufacturing a holder for supporting a personal item comprising a base member and a hanger connected to the base member, the hanger comprising a loop connected to a support base, wherein the loop at least partially surrounds the base member, the loop being adapted to support the personal item thereon, wherein the base member has at least one opening; the method comprising:

affixing the base member into or on an article of clothing or an accessory during manufacture of the article of clothing or the accessory using the at least one opening such that the loop is adapted to support a personal item thereon.

21. The method of claim 20, wherein the base member has two or four openings, and wherein the affixing the base member comprises using the two or four openings to affix the base member with the article of clothing or the accessory.

22. The method of claim 20, wherein affixing the base member comprises weaving or sewing the base member to the article of clothing or the accessory.

23. The method of claim 20, wherein the affixing the base member into or on the article of clothing or the accessory comprises affixing the base member into or on a handbag.

24. The method of claim 20, wherein the holder further comprises a fastening device, the fastening device having a first end configured for connection to the base member and a second end configured for connection to the support base, and wherein the method further comprises connecting the support base to the base member via the fastening device.

25. The method of claim 20, further comprising inserting the support base through the base member.

26. The method of claim 20 wherein the loop is made of an elastic material.

27. The method of claim 20, wherein the loop can flex relative to the base member, or vice versa.

28. An article of clothing or an accessory comprising a holder for supporting a personal item, the holder comprising:

a base member adapted to be inserted into or attached to an article of clothing or an accessory and a hanger connected to the base member, wherein the base member has at least one opening for securement of the base member with the article of clothing or the accessory;

the hanger comprising a loop connected to a support base, wherein the loop at least partially surrounds the base member, the loop being adapted to support the personal item thereon, and wherein the article of clothing or the accessory is capable of supporting a weight of the personal item hanging from the holder with the base member inserted into the article of clothing or the accessory.

29. The article of claim 28, wherein the base member has two or four openings for securement of the base member with the article of clothing or the accessory.

30. The article of claim 28, wherein the base member is adapted to be inserted into or attached to a handbag.

31. The article of claim 28, wherein the support base is connected to base member.

32. The article of claim 31, further comprising a fastening device, the fastening device having a first end configured for connection to the base member and a second end configured for conneection to the support base.

33. The article of claim 32, wherein one of the first end or the second end of the fastening device has a removable connection with one of the base member or the support base.

34. The article of claim 28, wherein the support base is inserted through the base member.

35. The article of claim 28, wherein the loop is configured to flex relative to the base member, or vice versa.

36. The article of claim 28, wherein a front face of the base member is spaced relative to a front face of the loop.

37. The article of claim 28, wherein the support base angles the base member away from the loop.

38. The article of claim 28 wherein the loop is made of an elastic material.

39. The article of claim 28, wherein the holder further comprises a groove that separates at least part of the base member and part of the loop.

40. An article of clothing or an accessory comprising a holder for supporting a personal item, the holder comprising:

a base member adapted to be inserted into or attached to an article of clothing or an accessory and a hanger connected to the base member;

the hanger comprising a loop connected to a support base, wherein the base member and support base are integrally formed, wherein the loop at least partially surrounds the base member, the loop being adapted to support the personal item thereon, wherein the article of clothing or the accessory is capable of supporting a weight of the personal item hanging from the holder with the base member inserted into the article of clothing or the accessory.

41. The article of claim 40, wherein the support base is part of the article of clothing or the accessory of which the base member is inserted into or attached to.

42. The article of claim 40, wherein the holder further comprises a groove that separates at least part of the base member and part of the loop.

43. The article of claim 40, wherein a front face of the base member is spaced relative to a front face of the loop.

44. The article of claim 40, wherein the support base angles the base member away from the loop.

45. The article of claim 40, wherein the support base extends from a face of the base member.

46. The article of claim 40, wherein the loop is configured to flex relative to the base member, or vice versa.

* * * * *